United States Patent [19]

Nelson

[11] 3,946,352

[45] Mar. 23, 1976

[54] THERMALLY RESPONSIVE SWITCH

[75] Inventor: Hjalmar N. Nelson, Weymouth, Mass.

[73] Assignee: Texas Instruments Incorporated, Dallas, Tex.

[22] Filed: Dec. 9, 1974

[21] Appl. No.: 530,915

[52] U.S. Cl. ..... 337/361; 337/365; 337/380

[51] Int. Cl.[2] ..... H01H 37/12

[58] Field of Search ..... 337/348, 358, 343, 346, 337/361, 365, 367, 380

[56] References Cited

UNITED STATES PATENTS

| | | | |
|---|---|---|---|
| 3,067,306 | 12/1962 | Epstein | 337/365 |
| 3,462,722 | 8/1969 | Bletz | 337/361 X |
| 3,624,354 | 11/1971 | Heidorn | 337/365 |

*Primary Examiner*—G. Harris

*Attorney, Agent, or Firm*—John A. Haug; James P. McAndrews; Russell E. Baumann

[57] ABSTRACT

A thermally responsive electrical switch characterized by low cost and long reliable service life includes a precalibrated snap-acting thermostatic member which is positioned outside the electrical circuit of the switch in heat-transfer relation to heater terminal means in the switch, whereby the member is economically mounted without requiring calibration during or after switch assembly and is arranged to avoid the deleterious effects of high current surges in the switch but is responsive to the occurrence of selected current levels in the switch to open the switch with snap action. Preferably spring biased cam means cooperate with the snap-acting member to permit initial snapping movement of the member while the member is free of significant loading, thereby to assure that such snapping movement occurs at precisely predetermined temperatures throughout the life of the switch.

18 Claims, 7 Drawing Figures

THERMALLY RESPONSIVE SWITCH

In thermally actuated switches of the snap-acting type which are intended to open circuits on the occurrence of selected current levels in the circuits, it is important that the switches be adapted to operate at precisely predetermined temperatures. However, in conventional switches of this type wherein thermally-responsive snap-acting members are commonly arranged within the electrical circuits of the switches, it has usually been necessary to calibrate the switches after securing the thermally responsive members in the switch circuits in order to assure that the switches operate at the desired temperatures. Such switch calibration is time consuming and expensive to perform. Further, if such a switch cannot be calibrated to the desired temperatures after assembly, the entire switch assembly must normally be discarded, adding further to the cost of such switches. In such conventional switches, the temperature responsive characteristics of the snap-acting members have also tended to vary during use as the members have been subjected to high current surges and to significant loading of the members during snapping movement of the members.

Accordingly, an object of the invention is to provide a thermally responsive switch which requires no calibration. Another object of the invention is to provide a switch wherein the current path is isolated from the snap-acting thermostatic disc. Another object of the invention is to provide a thermostatic switch with improved means for mounting the thermostatic element. Still another object of the invention is to provide a reliable, easily manufactured switch made up of a minimum number of parts. Other objects and features will be in part apparent and in part pointed out hereinafter.

The switch of this invention comprises a snap-acting thermostatic disc which is a non-current carrying member of the device and therefore not connected or mounted to any other current carrying elements of the switch. The switch also may have a cam and spring which work in conjunction with the disc to facilitate the switching. When a heat buildup occurs the disc snaps hitting a movable contact arm and thus bringing a movable contact out of engagement with a stationary contact. The snapping of the disc allows the cam to rotate to a position where the cam acts as a positive stop to the movable contact arm trying to come back into engagement with the stationary contact thereby removing loading from the disc. It is not until the disc cools down and snaps back again moving the cam back to its original position that the movable contact arm can return the movable contact back into engagement with the stationary contact. The thermally responsive switch requires no calibration during or after switch assembly because the preselected response temperature range of the bimetallic element is not altered during switch assembly. Also since the bimetallic element does not carry current, it is much more resistant to changes in its electrical and thermal properties. Further, because the disc is freed of significant loading as snapping movement of the disc is initiated, the snapping of the disc occurs at precisely predetermined temperatures.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
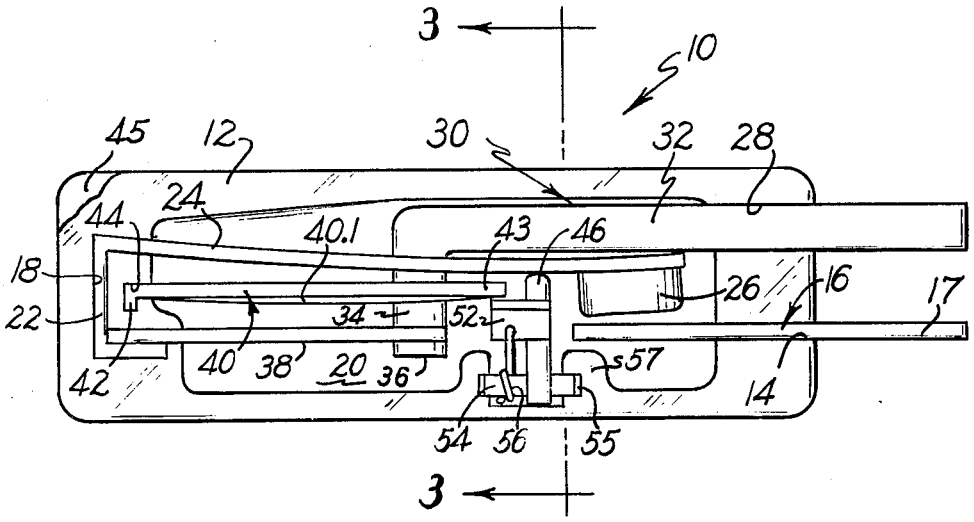
FIG. 1 is a plan elevation view showing the thermally responsive switch made in accordance with this invention with the cover partially cut away and with the movable contact in the open position.
Figure 2:
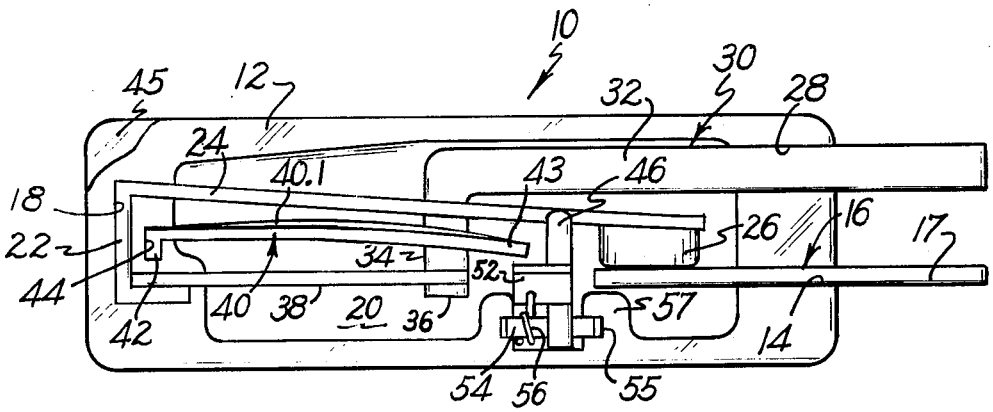
FIG. 2 is a plan elevation view similar to FIG. 1 of the thermally responsive switch made in accordance with this invention with the movable contact in the closed position.

Referring to the drawings, numeral 10 as shown in FIGS. 1 and 2 illustrates the switch of the present invention. The casing 12 made out of an insulating material such as a phenolic resin or bakelite has various slots at different levels to receive the components of the switch and a large central cavity 20 to allow room for the movement of the components and for heat transfer within the cavity 20. Thus, a first long narrow rectangular slot 14 extending from the cavity 20 exteriorily to the end of the casing houses stationary contact terminal 16 made out of an electrically conductive material such as silver. An end portion 17 of the terminal 16 extends out of the casing 12 at one end so as to be easily attached in a circuit where needed. The terminal is press-fitted or cemented or otherwise secured in the slot 14 in any conventional manner.

A second U-shaped slot 18 which opens into the large central cavity 20 as shown in FIGS. 1 and 2 houses a fixed end portion 22 (see FIG. 5) of a movable contact arm 24 made out of a spring material such as beryllium copper so that the main portion of the arm extends in cantilever relation into the casing cavity 20. On the distal end away from the fixed end portion 22 of the movable arm 24 is mounted a movable contact 26. This contact 26, preferably formed of a material of high electrical conductivity such as silver, is welded or otherwise secured to the contact arm 24 and positioned by the resiliently biased movable arm so that the contact is normally in engagement with the stationary contact terminal 16 in the as assembled state of the switch 10. That is, although the arm portion 22 is slidably received in slot 18, interfitting of the end portions 22 of the contact arm in slot 18 precisely positions the contact arm in the switch 10 so that the arm is adapted to provide and to permit selected movement of the contact 26 within the switch. Arm 24 is located closely adjacent a bimetallic member 40 to be discussed further later.

Figure 5:
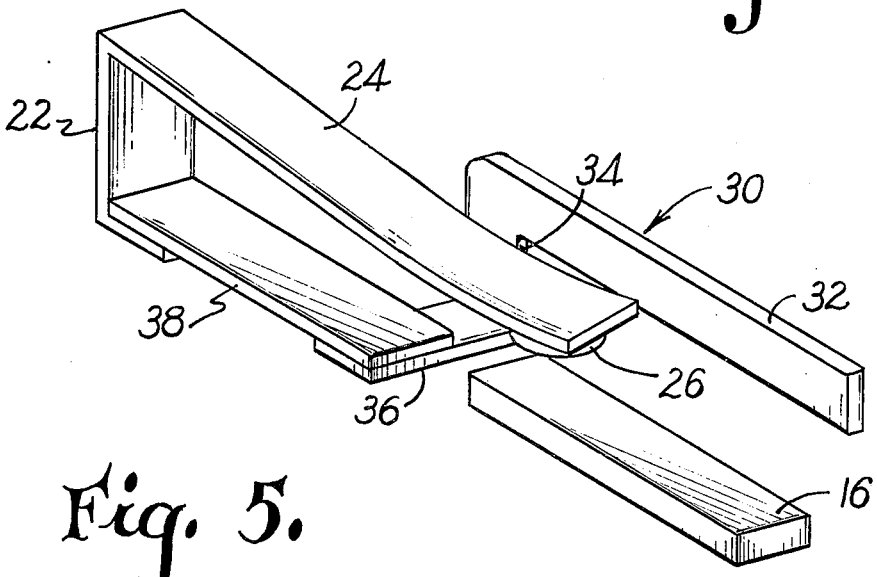
FIG. 5 is a perspective view of the current carrying path of the switch of this invention.

Another slot 28 holds a heater terminal 30 as shown in FIG. 1. See also FIG. 5. The heater terminal 30 has three portions, a top 32, a middle 34 and bottom 36, each of which are at right angles to the other two portions as best shown in FIG. 5. On the end of the heater terminal opposite the end extending out of the casing 12 preferably is attached a heater element i.e., main winding heater element 38. The heater element is attached as by welding between the end of the bottom portion 36 of the heater terminal 30 and the end portion 22 of the movable contact arm 24. If no heater element 38 of special electrical resistance material is used, a portion of the heater terminal 30 with a longer bottom 36 would be attached directly to the end portion 22 of the movable contact arm 24, this longer portion of the terminal serving as a heater means as will be understood. The position of the heater element is preferably generally parallel and closely adjacent in heat transfer relationship with bimetallic member 40 as shown in FIGS. 1 and 2. The heater element is formed of any one of a variety of materials of selected electrical conductivity so that the element is adapted to generate a predetermined amount of heat in response to selected flow of electrical current through the element 38. For example, the heater element 38 is preferably formed of rigid cold-rolled steel to provide the element with selected electrical heating characteristics. Alternately, heater elements of other rigid metals or the like are used for providing the heater with different electrical properties within the scope of this invention.

In accordance with this invention, an elongate snap-acting bimetallic thermostatic member 40 is positioned between heater element 38 and contact arm 24 as shown in FIGS. 1 and 2. The thermostatic member preferably has certain features which are conventional in snap-acting bimetallic thermostatic members of well known types. That is, the member has a dished portion indicated at 40.1 and has one layer of metal of low thermal coefficient of expansion (not individually shown) bonded to another layer of metal of relatively much higher coefficient of thermal expansion. Accordingly, it will be understood that the dished part of the member is adapted to move with snap-action from one dished configuration to an inverted dished configuration as the member is heated and to return with snap action to its original dished configuration when the member is subsequently cooled. Typically, the member 40 is adapted to snap from its original dished configuration when heated to a first selected temperature and is adapted to return with snap-action to its original dished configuration when subsequently cooled to a second, relatively lower selected temperature. Typically also the member 40 is adapted to undergo some small conventional creeping movement as the member is heated or cooled toward the selected temperatures at which such snap action occurs.

In accordance with this invention, the member 40 has a bent end piece or tab 42 or the like fitted into a slot 44 in the casing 12 to locate the member in the switch 10. That is, although the slot 44 slidably receives the tab end 42 of the member, the tab end and the slot are precisely interfitted to retain the member in a precise position with the main body portion of the member extending in cantilever relation into the casing cavity 20 in a plane generally parallel to, and in a selected, closely spaced heat-transfer relation to, the heater element 38 and with a part such as the distal end 43 of the member disposed in a selected position adjacent to the contact arm 24. A cover of insulating material or the like indicated at 45 is then secured to the casing 12 by ultrasonic welding or in other conventional manner for further securing the member 40 and other switch components within the casing.

In this arrangement, the thermostatic member 40 is not welded or otherwise attached to any current-carrying elements of the switch 10 but is adapted to receive heat from the heater element 38 which is proportional to the level of electrical current flow in the heater element. That is, when current in the switch 10 flows from terminal 32 through heater 38, contact arm 24, contact 26 and terminal 16 while switch 10 is in the closed circuit positions as shown in FIG. 2, the member 40 is thermally responsive to changes in temperature of the heater element caused by such current flow. Accordingly, the member 40 is adapted to move with snap-action from the dished configuration shown in FIG. 2 to the inverted dished configuration shown in FIG. 1 when current flow in heater 38 reaches a selected level. In this arrangement, a part of the member 40 such as the distal end 43 of the member is also adapted to engage the contact arm 24 as the member snaps from its original configuration, thereby to move the contact arm 24 to the open circuit or contacts position illustrated in FIG. 1. For example, when the terminals of the switch 10 are disposed in series with the main winding of an electrical motor the switch 10 is adapted to open the motor winding circuit on the occurrence of an overload main winding current.

In the construction of the switch 10 above described, the thermostatic member 40 is easily provided with, and tested to assure the presence of, selected thermal response characteristics prior to installation of the member in the switch 10. The mounting of the member in the switch does not require welding of the member or the like and accordingly, the thermal response characteristics of the member are not significantly altered during installation in the switch and the heat-transfer mounting of the member relative to the heater element 38 is not subject to significant variation from switch to switch so that the switch 10 is thereby adapted to operate at precisely predetermined temperature levels. Further, the member 40 is not disposed in the switch circuit and is therefore spared any of the deleterious effects that might be caused by having excessive current flow through the thermally responsive member 40. That is, the member 40 is responsive to current flow in the switch circuit and is adapted to open that circuit when current in the circuit reaches a selected level but the member does not tend to become excessively overheated or otherwise damaged on the occurrence of high current surges in the switch circuit. Of course, when the member 40 has moved with snap-action to open the switch circuit as above described, current in the heater element is interrupted and the member 40 is then gradually cooled to ultimately return with snap-action to its original dished configuration and to permit the contact arm 24 to resiliently return the contact 26 to its closed circuit position with snap-action. In this way, the switch 10 achieves reliable operation over a long reliable service life while utilizing an extremely low-cost switch construction.

Figure 6:
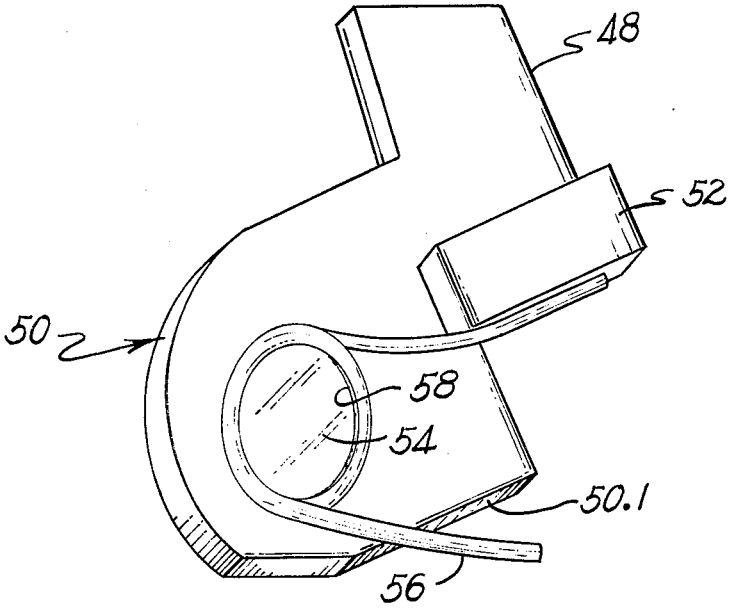
FIG. 6 is a perspective view of the cam.

In accordance with this invention a cam 46 is preferably used to allow member 40 to be free from external forces when the above-described snap-acting movement of the member is initiated. In this way, the switch 10 is adapted to operate at more precisely predetermined temperatures and the member is adapted to retain its original thermal response characteristics throughout a longer service life. Cam 46 as best shown in FIG. 6 is made up of a nose portion 48, a central body 50 and a tab section 52. Central body 50 has a bored out hole 58 through it in which a shaft 54 such as nylon is inserted and which acts as the point around which the cam rotates. The two ends of shaft 54 which extend out of hole 58 on each side rest in slots 55 formed in bosses 57 on casing 12 which extend into the casing cavity 20. A single loop spring 56 biases cam 46 to rotate to a certain limited extent in a counter clockwise direction as viewed in FIG. 6 but permits the cam to be rotated in a clockwise direction by the application of force on the cam tab 52 as will be understood. If desired, a cam stop 50.1 is arranged to engage the wall of the casing 12 for limiting rotation of the cam in a clockwise direction while the shape of the spring 56 provides a selected degree of rotation in the opposite direction.

Figure 3:
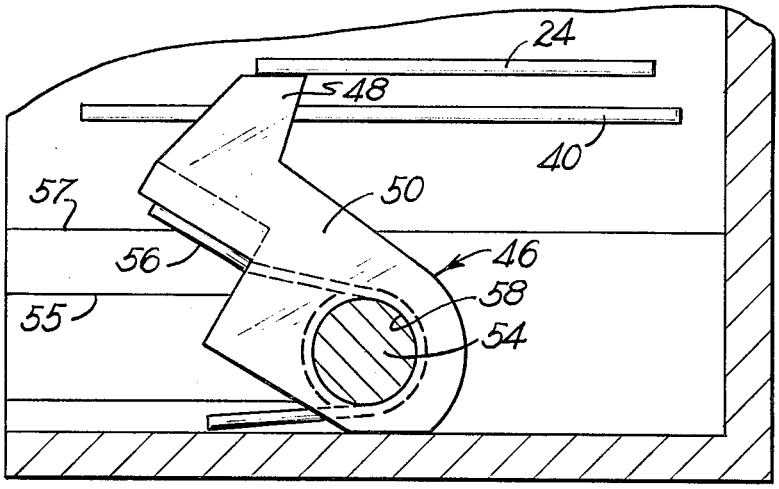
FIG. 3 is an enlarged partial section view along line 3—3 of FIG. 1 showing a switch cam in one position.

In accordance with this invention, the cam 46 is mounted and proportioned so that the cam 46 is allowed to rotate to a first or up cam position as shown in FIG. 3 when bimetallic member 40 snaps to the open contacts or circuit position shown in FIG. 1. Immediately after arriving at this up position, cam 46 is not in contact with either member 40 or arm 24. However, shortly thereafter bimetallic member 40 starts to cool off as a result of opening of the switch circuit and consequently starts to creep back a short distance toward the closed contact position in a manner conventional with such thermostatic members as has been previously noted. At this point, before the bimetallic member cools to the closure temperature at which time it snaps back to allow the contacts 26, 16 to come into engagement again, arm 24 is stopped from following the creeping bimetallic member as shown in FIG. 3 by engagement with the nose 48 of cam 46. That is, the resiliency of contact arm 24 tending to move the arm to its closed circuit or contacts position, as related to the direction in which the force of the arm 24 is applied to the arm relative to the cam shaft 54, is insufficient to overcome the spring 56. Therefore, at this point, member 40 no longer has a closure force exerted on it by arm 24 and therefore only the thermal characteristics of the bimetal composite member 40, as predetermined by material selection and configuration, control the reclosing temperature of the member 40. Accordingly, the member 40 is adapted to snap back to the configuration shown in FIG. 2 only when the member 40 has cooled to precisely its predetermined closure temperature.

Figure 4:
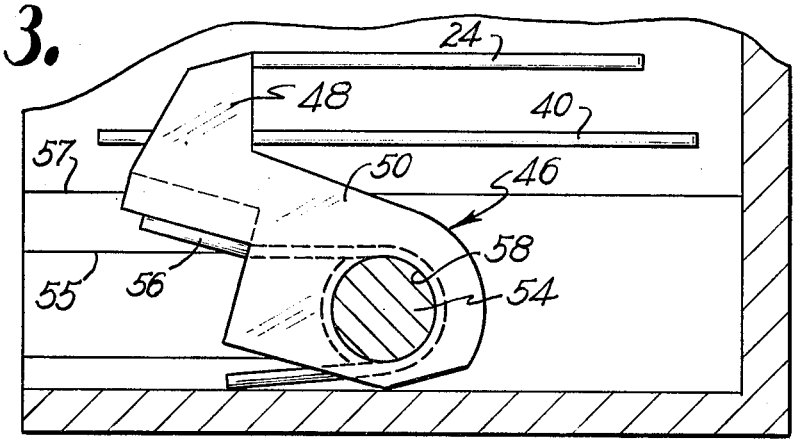
FIG. 4 is similar to FIG. 3 with the cam held in another position by the movable contact arm.
Figure 7:
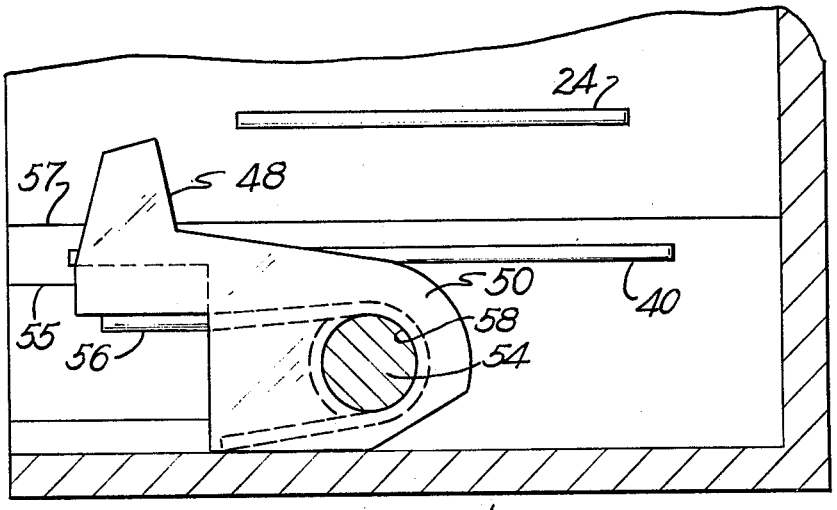
FIG. 7 is similar to FIG. 3 with the cam in the furthest downward position.

When member 40 then subsequently hits its reclosing temperature, it snaps back to the contacts closed position shown in FIG. 2. When the disk member 40 snaps back it engages tab 52 on the cam and causes cam 46 to return to a second or down cam position as shown by FIG. 7 which in turn allows arm 24 with contact 26 mounted on it to move back into engagement with stationary contact terminal 16 with snap action. At this point, the switch 10 is in closed circuit position so that the member 40 is again adapted to be heated toward its reopening temperature as the current flow in heater 30 tends to reach the operating level of the switch as above-described. Member 40 initially holds cam 46 in the down cam position until the member again starts to heat up and starts to creep a short distance toward the contacts open position. Cam 46 follows member 40 up during this creep action of the member until cam nose portion 48 engages and is stopped by an edge of arm 24 as shown by FIG. 4. At this point, member 40 is once again free from external forces and therefore only thermal characteristics of the member will control the opening temperature point of the member. Finally, when member 40 has been heated to its opening temperature and moves with snap-action to move the contact arm 24 to its open circuit position, movement of the contact arm releases edge engagement of the arm with the cam 46 and allows the cam to return to the position shown in FIG. 3.

As has been noted, a cover 45 of a material preferably matching the casing 12 is preferably used with the casing 12 as indicated in FIG. 1. If desired the case has a plurality of projections and slots complementary to the casing 12 and is used in a complementary manner with casing 12 to seal the device and hold the various components in place in the grooves or slots made for them in casing 12. The cover is affixed to the casing 12 as by ultrasonic or electron beam welding or the like.

Although the present invention has been shown and illustrated in terms of specific preferred embodiments, it will be apparent that changes and modifications are possible without departing from the spirit and scope of the inventions as defined in the appended claims. For example, tab section 52 of cam member 46 can be removed and a manual reset button may be mounted on the casing to replace the automatic reset for the switch by tab 52 and bimetallic member 40. Alternately an additional heater terminal can extend into the casing 12 between the terminals 16 and 32 and can extend in part in a plane along side the member 40 to connect to the contact arm portion 22, such an additional heater terminal being adapted to be connected to the start winding of an electrical motor for example. This invention includes all such modifications and equivalents falling within the scope of the appended claims.

I claim:

1. A thermally responsive switch comprising a casing, first terminal means, complementary terminal means cooperating with said first terminal means to define a current path through said switch, said complementary terminal means having a contact arm portion movable between positions engaging and disengaging said first terminal means to open and close said circuit path through said switch and resiliently biased to one of said positions, means on said casing slidably receiving said first and complementary terminal means for precisely locating said terminal means within said casing, a multilayer thermostatic member movable in a predetermined manner in response to predetermined changes in temperature thereof, and means on said casing slidably receiving said thermostatic member for precisely locating said thermostatic member outside said circuit path in position to move said terminal arm portion between said open and closed circuit positions in response to said selected changes in temperature of said member.

2. A thermally responsive switch as set forth in claim 1 in which said multilayer thermostatic member is a snap-acting member movable from a first closed circuit position to a second open circuit position.

3. A thermally responsive switch as set forth in claim 2 wherein said means on said casing for slidably receiving said first and complementary terminal means and said thermostatic member is a plurality of slots in said casing.

4. A thermally responsive switch as set forth in claim 3 wherein said thermostatic member has a tab end which is secured in one of said casing slots for locating said member in said casing.

5. A thermally responsive switch as set forth in claim 4 further comprising at least one heater element.

6. A thermally responsive switch as set forth in claim 5 further including a cover.

7. A thermally responsive switch comprising a casing with a plurality of slots to receive components of said switch, a snap-acting dish-shaped bimetallic member having one end slidably received for precise location in one of said slots and being movable at the other end from a closed contacts position to an inverted dish-shaped open contacts position, first terminal means slidably received for precise location by another of said slots, and complementary terminal means having a movable contact arm with a first end slidably received in still another of said slots and second end biased so that said arm positioned closely adjacent said bimetallic member has one end in contact with complementary terminal means when said member is in the closed contacts position, said complementary terminal means cooperating with said first terminal means to define a current path through said switch, said bimetallic member being spaced from said current path when switch carries current.

8. A thermally responsive switch as set forth in claim 7 further comprising a cam which moves between a first cam position and a second cam position as said bimetallic member moves between said closed contacts position and said open contacts position thereby allowing said bimetallic member to be free from external forces from said arm when snapping from said open contacts position to said closed contacts position.

9. A thermally responsive switch as set forth in claim 8 in which the cam has a tab portion which is engaged by said bimetallic member as said member moves from said open contacts position to said closed contacts position thereby moving said cam from said first position to said second position.

10. A thermally responsive switch as set forth in claim 7 further comprising at least one heater element.

11. A thermally responsive switch as set forth in claim 10 further including a cover with a plurality of projections and slots which work in complementary manner with said casing to hold the components in place.

12. A thermally-responsive electrical switch adapted to open an electrical circuit in response to flow of selected current in the circuit, said switch comprising a casing of dielectric material having a bottom, having side-walls upstanding from said bottom to define a casing chamber, and having an open casing top, said casing having a pair of slots in a first one of said casing side-walls open at said casing top and extending from said casing chamber exteriorly of said casing, having an additional U-shaped slot in a second, opposite casing side-wall which is open at said casing top and which has its opposite ends opening into said casing chamber, and having a third L-shaped slot in said second casing side-wall which is open at said casing top and which has one of its ends opening into said casing chamber between said ends of said U-shaped slot, a first terminal slidably disposed in one of said pair of slots with one end of said terminal in said casing chamber and with an opposite terminal end extending from said casing, a second terminal having an end portion slidably disposed in the other of said pair of slots to extend from said casing, having a U-shaped portion slidably received in said U-shaped casing slot, having a heater portion extending between said U-shaped and end portions of said second terminal through said casing chamber, and having a resilient portion extending in cantilever relation from said U-shaped terminal portion into said casing chamber, said resilient arm portion being normally biased to engage said first terminal to close an electrical circuit through said switch and being movable to disengage said first terminal to open said circuit, and a thermostatic member having an L-shaped tab portion slidably received in said third casing slot and having a dish-shaped snap-acting portion extending in cantilever relation into said casing chamber in selected closely spaced heat-transfer relation to said heater portion of said second terminal, said snap-acting portion being normally disposed in a first dished configuration to permit said movable portion of said second terminal to remain in said closed circuit position but being adapted to be heated by selected current flow in said heater terminal portion to move with snap-action to an inverted dished configuration and to engage a distal end of said member with said movable portion of said second terminal to move said movable terminal portion to said open circuit position.

13. A thermally responsive switch comprising a casing, a snap-acting dish-shaped bimetallic member movable from a closed contacts position to an inverted dish-shaped open contacts position, first terminal means, complementary terminal means cooperating with said first terminal means to define a current path through said switch, said complementary terminal means having a contact arm portion movable between said closed contacts position and said open contacts position, and a cam which moves between a first cam position and a second cam position as said bimetallic member and contact arm move between said closed contacts position and said open contacts position thereby allowing said bimetallic member to be free from external forces when snapping.

14. A thermally responsive switch as set forth in claim 13 in which the cam has a tab portion which is engaged by said bimetallic member as said member moves from said open contacts position to said closed contacts position thereby moving said member from said first position to said second position.

15. A thermally responsive switch as set forth in claim 14 further comprising at least one heater element.

16. A thermally responsive switch as set forth in claim 15 further including a cover.

17. A thermally-responsive electrical switch comprising a base, first terminal means mounted on said base, second terminal means mounted on said base having an arm movable between a closed circuit position engaging said first terminal means and an open circuit position spaced from said first terminal means, said arm being normally biased to one of said circuit positions, cam means mounted relative to said arm for movement between a first cam position permitting movement of said arm in response to said arm bias and a second cam position preventing movement of said arm in response to said arm bias, said cam means being normally biased to said second cam position and having a cam surface engageable for moving said cam means to said first cam position, and a multilayer thermostat metal member having a mounting portion and having a dished portion movable in response to changes in temperature of said member, said movable member portion being initially movable in a first direction with creep action and then with snap-action as said member is heated for moving said movable member portion from an original dished configuration to an inverted dished configuration and being initially movable in an opposite direction with creep action and then with snap-action as said member is subsequently cooled for returning said movable member portion to said original dished configuration, said mounting portion of said member being secured relative to said base, said member mounting permitting movement of said movable member portion in one direction with snap-action at a first temperature to engage and move said arm into said other circuit position against said arm bias and permitting movement of said cam means in response to said cam bias, permitting movement of said movable arm portion in the other of said directions with creep action at a second temperature to permit said arm to disengage said member from said arm while said arm is retained in said other circuit position by said cam means, and for permitting subsequent movement of said movable arm portion in said other direction with snap-action while said member is disengaged from said cam to engage said member with said cam surface to move said cam means to said first cam position to permit said arm to return to said one circuit position in response to said arm bias.

18. A thermally-responsive electrical switch as set forth in claim 17 wherein said cam means are mounted to be biased from said first cam position into engagement with a part of said movable arm when said arm is in said one circuit position for retaining said cam means in said first cam position and wherein said thermostat member mounting permits movement of said movable member portion in said one direction with creep action at a fourth temperature to disengage said movable member portion from said cam surface while said cam means are retained in said first cam position by engagement with said movable arm part, whereby said movable member portion is adapted to move with snap-action in said one direction at said first temperature while said member is free of engagement with said cam surface.

* * * * *